United States Patent [19]

Leupold

[11] Patent Number: 4,894,360

[45] Date of Patent: Jan. 16, 1990

[54] METHOD OF USING A FERROMAGNET MATERIAL HAVING A HIGH PERMEABILITY AND SATURATION MAGNETIZATION AT LOW TEMPERATURES

[75] Inventor: Herbert A. Leupold, Eatontown, N.J.

[73] Assignee: The United States of America as represented by the Secretary of the Army, Washington, D.C.

[21] Appl. No.: 355,582

[22] Filed: May 19, 1989

[51] Int. Cl.[4] ..... H01F 7/22

[52] U.S. Cl. ..... 505/1; 335/216; 335/284

[58] Field of Search ..... 335/216, 284; 505/1; 174/125.1

[56] References Cited

U.S. PATENT DOCUMENTS 3,370,258 2/1968 Williams ..... 335/284 X 4,722,134 2/1988 Wilson ..... 335/216 X

*Primary Examiner*—George Harris

*Attorney, Agent, or Firm*—Michael Zelenka; Roy E. Gordon

[57] ABSTRACT

A ferromagnet material having a high permeability and saturation magnetization at low temperatures is used to induce superconducting currents in a ring of a superconducting material where the ferromagnet material has a lower transition temperature than the superconductive material.

8 Claims, 1 Drawing Sheet

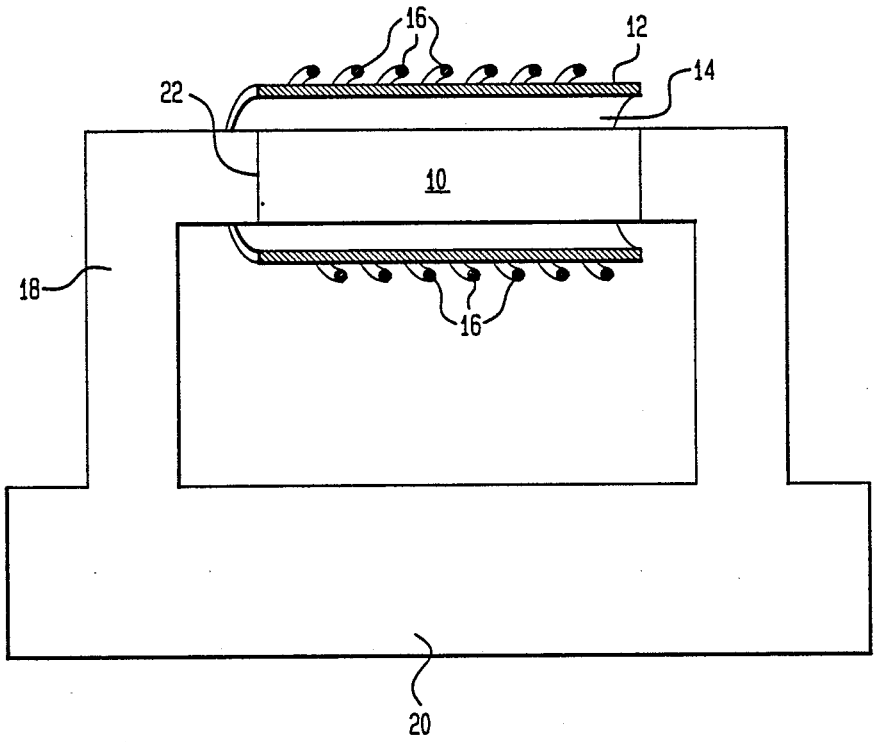
16
12
14
22
10
18
16
20

METHOD OF USING A FERROMAGNET MATERIAL HAVING A HIGH PERMEABILITY AND SATURATION MAGNETIZATION AT LOW TEMPERATURES

The invention described herein may be maufactured, used, and licensed by or for the Government for governmental purposes without the payment to me of any royalty thereon.

This invention relates in general to a method of using a ferromagnet material having a high permeability and saturation magnetization and in particular to the use of such a method to induce superconducting currents in a ring of superconductive material where the ferromagnet material has a lower transition temperature than the superconductive material.

BACKGROUND OF THE INVENTION

In U.S. patent application Ser. No. 326,777 filed 20 Mar. 1989 of H. A. Leupold for "Method of Transforming a Passive Ferromagnetic Material Into a Permanent Magnet" and assigned to a common assignee, and with which this application is copending, a method is described in which superconducting persistent currents are induced in annular rings or current loops with the aid of a high permeability material such as iron. The method includes the steps of:

(A) encasing a bar of iron in an annular shell of a superconductive material at a temperature above the transition temperature of the superconductive material, (B) placing the encased iron into an applied axial magnetic field providing sufficient oersteds to magnetize the iron thereby enclosing a large amount of flux in the superconducting shell, (C) lowering the temperature to below the transition temperature of the superconductive material whereupon all of the enclosed flux is permanently trapped, and (D) removing the applied axial magnetic field.

There are even higher permeability ferromagnet materials however, such as gadolinium that obtain such permeabilities only at low temperatures. For the method of Ser. No. 326,777 to work in such a case, the transition temperature of the encasing superconductive material must be even lower.

SUMMARY OF THE INVENTION

The general object of this invention is to use the high permeabilities of ferromagnets at low temperatures to charge superconductive rings where the ferromagnet material has a lower transition temperature than the superconductive material. A more particular object of the invention is to take advantage of the high saturation magnetization of the ferromagnet material gadolinium to charge a superconductive ring even when the gadolinium has a lower transition temperature than the superconductive material.

It has now been found that the aforementioned objects can be attained by a method including the steps of:

(A) placing a bar of a ferromagnet material in an annular ring of superconductive material at a temperature above both the transition temperature of the ferromagnet material and the transition temperature of the superconductive material, (B) applying an axial magnetic field of sufficient strength to saturate the ferromagnet when the ferromagnet is cooled to below its transition temperature, (C) cooling the ferromagnet to below its transition temperature without cooling the superconductive material so that the superconductive material does not become superconducting before the saturation of the ferromagnet, (D) cooling the superconductive material to below its transition temperature, (E) removing the ferromagnet and the applied field, and (F) allowing the system to warm to a convenient operating temperature that must be below the transition temperature of the superconductive material.

In carrying out the method of the invention, one cannot allow the superconductive material to become superconducting before the ferromagnet is magnetized. This is because if the superconductive material becomes superconducting before, it will not allow the ferromagnet to become magnetized. In this connection, it is possible by a combination of heaters on the superconductive ring, a thermal barrier between ferromagnet and superconductive material, and refrigeration contacts on the ferromagnet to maintain a large enough temperature gradient between the superconductive material and the ferromagnet so that the superconductive material becomes superconducting after the ferromagnet becomes permeable as the temperature of the system as a whole is lowered. Then, the flux will be trapped after the superconductivity begins and the temperature of the system can be equilibrated and raised to the desired temperature level.

In carrying out the method of the invention, when the ferromagnet is lowered to below its transition temperature, the applied field can align almost all of the molecular magnets that constitute the ferromagnet in the direction of the applied field. Complete alignment is called magnetic saturation.

The superconductive ring must also conserve flux trapped in its interior hole so that flux previously furnished by the ferromagnet and the applied field can then be sustained by supercurrents generated in the superconductive ring upon removal of the ferromagnet and the applied field.

As the superconductive material used in the method, one must use a high transition temperature material with sufficient strength to trap up to 6 tesla of flux density. Examples of such materials include $YBa_2Cu_3O_{7-y}$, $Bi_2(Ca,Sr)_3Ca_2O_{8+y}$, and $Tl_2Ca_{1.5}BaCu_3O_{8.5-y}$.

The method of the invention takes advantage of the high saturation magnetization of a ferromagnet to charge a superconductive ring even when that ferromagnet has a lower transition temperature than the superconductive material.

In carrying out the method of the invention, the superconductive ring should be kept at a uniform temperature. This can be accomplished by a uniform heating coil overlying the surface of the superconductive ring. Some mechanism must also be provided to cool the ferromagnet to below its transition temperature. This can be conveniently accomplished by the use of cold fingers extending from a refrigerant to the ends of the ferromagnetic material. Separating the ferromagnet material from the surrounding superconductive material is a thermal barrier in the form of either an empty space or an insulating material so that a thermal gradient between superconductive material and ferromagnet can be maintained by heating coils wound uniformly on the outer cylindrical surface of the superdonductive material. Some provision should also be made for the cooling of the superconductive material if its transition temperature is below room temperature. This can be effected by limited thermal contact with a reservoir or imperfect insulation from the colder ferromagnet.

DESCRIPTION OF THE DRAWING

The drawing illustrates a plan view of how the ferromagnet and superconductive material can be combined to carry out the method of the invention.

Referring to the drawing, ferromagnet material as for example gadolinium, 10, is separated from a superconductive material, 12 by an empty space, 14 so that a thermal gradient between superconductive material, 12 and ferromagnet material 10 can be maintained by heating coils, 16, wound uniformly on the outer cylindrical surface of the superconductive material, 12. The ferromagnet material, 10 can be cooled by the use of cold fingers, 18 extending from a cold reservoir, 20 to the end, 22 of the ferromagnet material.

DESCRIPTION OF THE PREFERRED EMBODIMENT

A bar of gadolinium is placed in an annular ring of $YBa_2Cu_3O_{7-y}$. An axial magnetic field of several hundred gauss is then applied at about 80° K. The gadolinium is then cooled to below 50° K. while the superconductive material is maintained at 80° K. by heating coils wound uniformly on the outer cylindrical surface of the superconductive material and a thermal barrier between the gadolinium and the superconductive material. The superconductive material is then cooled to below 70° K. and the gadolinium and the applied field removed. The system is then allowed to warm to 60° K.

I wish it to be understood that I do not desire to be limited to the exact details of construction shown and described for obvious modifications will occur to a person skilled in the art.

What is claimed is:

1. Method of using a ferromagnet material having a high permeability and saturation magnetization to induce superconducting currents in a ring of superconductive material where the ferromagnet material has a lower transition temperature than the superconductive material, said method including the steps of:

(A) placing a bar of a ferromagnet material in an annular ring of a superconductive material at a temperature above both the transition temperature of the ferromagnet material and the transition temperature of the superconductive material, (B) applying an axial magnetic field of sufficient strength to saturate the ferromagnet when the ferromagnet is cooled below its transition temperature, (C) cooling the ferromagnet to below its transition temperature without cooling the superconductive material so that the superconductive material does not become superconducting before the saturation of the ferromagnet, (D) cooling the superconductive material to below its transition temperature, (E) removing the ferromagnet and the applied field, and (F) allowing the system to warm to a convenient operating temperature which must be below the transition temperature of the superconductive material.

2. Method according to claim 1 wherein the ferromagnet is cooled to below its transition temperature without cooling the superconductive material by combining heaters on the superconductive material, a thermal barrier between ferromagnet and superconductive material and refrigeration contacts on the ferromagnet.

3. Method according to claim 1 wherein the ferromagnet material is gadolinium.

4. Method according to claim 1 wherein the superconductive material is selected from the group consisting of $YBa_2Cu_3O_{7-y}$, $Bi_2(Ca,Sr)_3Cu_2O_{8+y}$, and $Tl_2Ca_{1.5}BaCu_3O_{8.5-y}$.

5. Method according to claim 4 wherein the superconductive material is $YBa_2Cu_3O_{7-y}$.

6. Method according to claim 4 wherein the superconductive material is $Bi_2(Ca,Sr)_3Cu_2O_{8+y}$.

7. Method according to claim 4 wherein the superconductive material is $Tl_2Ca_{1.5}BaCu_3O_{8.5-y}$.

8. Method of using a ferromagnet material, gadolinium, having a high permeability and saturation magnetization to induce superconducting currents in a ring of superconductive material, $YBa_2Cu_3O_{7-y}$, where the gadolinium has a lower transition temperature than the $YBa_2Cu_3O_{7-y}$, said method including the steps of:

(A) placing a bar of gadolinium in an annular ring of $YBa_2Cu_3O_{7-y}$ at about 80° K., (B) applying an axial magnetic field of several hundred gauss to saturate the gadolinium when the gadolinium is cooled below its transition temperature, (C) cooling the gadolinium to below 50° K. without cooling the $YBa_2Cu_3O_{7-y}$, (D) cooling the $YBa_2Cu_3O_{7-y}$ to below 70° K., (E) removing the gadolinium and the applied field, and (F) allowing the system to warm to about 60° K.

* * * * *